United States Patent [19]

O'Flanagan

[11] Patent Number: 4,601,472

[45] Date of Patent: Jul. 22, 1986

[54] SIGHTING DEVICE FOR A GOLF PUTTER

[76] Inventor: Michael O'Flanagan, "Sweet Auburn", Cherrywood Road, Loughlinstown, Co. Dublin, Ireland

[21] Appl. No.: 547,919

[22] Filed: Nov. 2, 1983

[30] Foreign Application Priority Data

Nov. 4, 1982 [IE] Ireland ..... 2633/82

[51] Int. Cl.[4] ..... A63B 69/36

[52] U.S. Cl. ..... 273/186 A; 273/163 R; 273/186 C

[58] Field of Search ..... 273/163 R, 163 A, 164, 273/186 C, 183 E, 194 A, 183 D, 183 R, 35 A, 186 A; 350/612, 616, 626, 627

[56] References Cited

U.S. PATENT DOCUMENTS

| | | | |
|---|---|---|---|
| 1,540,409 | 6/1925 | McCray | 350/616 |
| 1,556,062 | 10/1925 | Baugh | 273/163 R |
| 2,309,544 | 1/1943 | Scharff | 350/626 X |
| 2,463,798 | 3/1949 | Paisley | 273/163 R |
| 2,503,506 | 4/1950 | Miller | 273/163 R |
| 3,273,891 | 9/1966 | Grim | 273/163 R |
| 3,810,633 | 5/1974 | Scott | 273/163 R X |
| 3,934,882 | 1/1976 | Whittaker | 273/35 A X |
| 4,053,160 | 10/1977 | Salata | 273/163 A |

FOREIGN PATENT DOCUMENTS

| | | | |
|---|---|---|---|
| 273546 | 7/1927 | United Kingdom | 273/163 R |

*Primary Examiner*—George J. Mario

*Attorney, Agent, or Firm*—Scully, Scott, Murphy & Presser

[57] ABSTRACT

A sighting device for a golf putter comprises a mounting frame housing an eye aligning mirror having a horizontally disposed reflective surface and a ball and target aligning mirror having a reflective surface extending at an angle of approximately 135° to the putting face of the putter blade. The frame includes a front flange which extends downwardly over the putting face of the blade. The device is releasably mounted on the blade by a deformable bonding agent which fills a chamber defined by the rear face of the flange, the striking face of the putter and spaced-apart ribs extending rearwardly of the flange to engage against the striking face. A pair of lugs extend sidewardly of the frame and each is formed with a through hole in which an adjusting screw for adjusting the position of the device on the putter blade are threadingly engaged.

The device is used for aligning the putting face of the blade square to a target path between a ball and target while aligning the eye of the player over the target path. The device is adapted for releasably mounting on any putter blade without alteration of the blade so that the putter may be restored to its original condition after the device is removed for use in competitive play under the rules of golf.

11 Claims, 7 Drawing Figures

SIGHTING DEVICE FOR A GOLF PUTTER

BACKGROUND OF THE INVENTION

The invention relates to a sighting device for releasably mounting on the blade of a golf putter.

One of the most difficult operations in playing the game of golf is putting the ball. The object of putting is to strike the ball so that it travels along a target path between the ball and hole to drop into the hole. In order to achieve a successful putt the bottom horizontal face or sole of the putter blade must be lined up in a horizontal plane and the front or putting face of the putter must be arranged in a plane at right angles to the target line between the ball and hole. In addition, the ball must be struck as close as possible to the so called sweet-spot on the putting face. Normally this sweet-spot is located approximately mid-way along the putting face of the blade.

The co-ordination of all these requirements is difficult and studies have shown that more than half of the successful putts made are as a result of inter-compensationary errors in the execution of these steps.

One of the difficulties is that the human eye, unaided, is not capable of accurately drawing an imaginary target path between the ball and hole and subsequently aligning the putter and his own eye at the required angles to this line to achieve a successful putt.

Several sighting devices have been developed for golf putters however as will be discussed below none of these devices has been found to be particularly successful.

Known sighting devices may be broadly divided into four groups. Firstly there are devices which are mounted on the shaft of a putter which are unsatisfactory because they are generally unwieldly, adversely effect the natural balance of a club, and tend to cause parallax.

The second group of sighting devices are specially constructed golf putters. This specification describes a specially constructed golf putter in which is permanently mounted an inclined ball and target aligning mirror and a horizontal eye aligning mirror for aligning the eye of a player. Such golf putters are unsatisfactory primarily because they cannot be used under the rules of golf. It may be useful for a player to train using such a putter however when playing the game he must readjust back to his own putter without any sighting device and with the attendent disadvantages of a change in size, shape, weight and particularly balance. The most important disadvantage of this putter is that it is a separate item of equipment which the player must train with and is not a putter which can be used in play under the rules of golf.

The third class of sighting device is of the type which must be used in association with a particular putter. Generally the putter blade and sighting device have some form of complementary formations which are interengaged for mounting the device on the putter. Such devices essentially entail a combination of a specially constructed putter with a detachable sighting device. These devices not only suffer from the disadvantages of requiring a separate putter which cannot be used when playing under the rules of golf but are also optically unsatisfactory in that they only partially assist the player in putting the ball correctly in practice.

The final group of sighting devices are devices which it is claimed may be mounted on the blade of any putter and the blade is returned to its normal condition when the device is removed.

Optically, these devices are unsatisfactory in that while an inclined mirror on its own is of some assistance in lining a putt up correctly it is not fully accurate as the orientation of the putter face to the ball and the target path between the ball and pin will vary depending on the position of the player's eye. In addition, the device adversely effects the balance of the club with the result that if a ball is struck by the putter with the device attached with the same force as with the device removed not only will the ball be very unlikely to travel in the same direction but will not travel the same distance. In addition, the device described can only be mounted on putters having a shaft which extends from either end of the putter. Such putters are generally called bladed putters. It would be very difficult to use this device with a bladed putter having a curved back face and it would not be possible to mount such a device on a putter having a shaft which extends from the center of the putter blade—a so called center shafted putter.

In some of these devices, an inclined mirror is not sufficient to achieve the correct orientation of the putting face of a putter to a target line between the ball and pin as this will vary depending on the position of the player's eye. Further, the device can only be used with a putter blade having a flat continuous rear face. Only a relatively small percentage of putters presently on sale have such a flat continuous rear face. Further, such a device when attached to a putter adversely effects the normal balance of the putter and not only will a ball struck the same blow with the same putter with and without the sighting device attached be unlikely to travel in the same line but would also not travel the same distance.

OBJECTS OF THE INVENTION

One object of the invention is to provide a sighting device which may be attached to the blade of any type of putter without having to modify the putter blade so that the same putter may be used by a player in both practice and play under the rules of golf.

SUMMARY OF THE INVENTION

According to the invention there is provided a sighting device for releasably mounting on the blade of a golf putter having a substantially planar front putting face with a substantially centrally disposed sweet spot, the sighting device comprising:

a mounting frame;

an eye aligning mirror housed in the frame and having a reflective surface extending in use substantially at right angles to the putting face of the blade;

a ball and target aligning mirror housed in the frame adjacent the eye aligning mirror;

the ball and target aligning mirror having a reflective surface inclined rearwardly upwardly at an angle of approximately 225° with respect to the putting face;

a frame including means for releasably mounting the device on a putter blade without alteration of the blade so that the putter is restored to its original condition after the device is removed; and the device in use aligning the putting face of the blade square to a target path between a ball and target while aligning the eye of the player over the target path.

In one embodiment of the invention the frame comprises a deformable bonding agent.

In a particularly preferred embodiment of the invention the flange extends over the sweet spot of the putting face of a putter blade and the flange comprises a substantially vertically disposed planar front face for striking a ball.

Usually the flange includes formations projecting from the rear face of the flange to define, in use, together with the putting face of a putter blade a chamber for accommodating a predetermined quantity of fixing compound so that a ball struck off the front face of the flange will travel in substantially the same direction and substantially the same distance as when struck with the same blow off the sweet spot of the same putter blade without the sighting device attached.

Typically the formations comprise a pair of spaced-apart downwardly extending ribs.

In another embodiment of the invention the device includes an adjusting means for aligning the mirror relative to a putter blade.

Preferably the adjusting means comprises a pair of spaced-apart adjusting screws, a pair of sideward extension lugs on the mounting frame, and means for threadingly engaging the screws and the lugs, the shank of each screw extending through the corresponding lug to engage against the top face of the putter blade for adjustment of the mirrors relative the blade in a substantially vertical plane.

In one embodiment of the invention the reflective surface of the eye aligning mirror extends below and forwardly of the reflective surface of the ball and target aligning mirror, the reflective surfaces forming a substantially continuous reflective surface in which the target path is viewed.

In an alternative embodiment of the invention the eye aligning mirror extends below and sidewardly of the ball and target aligning mirror.

In a still further embodiment of the invention the mounting frame includes a pair of side flanges extending upwardly from the side marginal edges of the reflective surfaces of the mirrors.

These features and other features, advantages and objects of the invention will become readily apparent from the following description, when taken in conjunction with the accompanying drawings.

DESCRIPTION OF PREFERRED EMBODIMENTS

Figure 1:
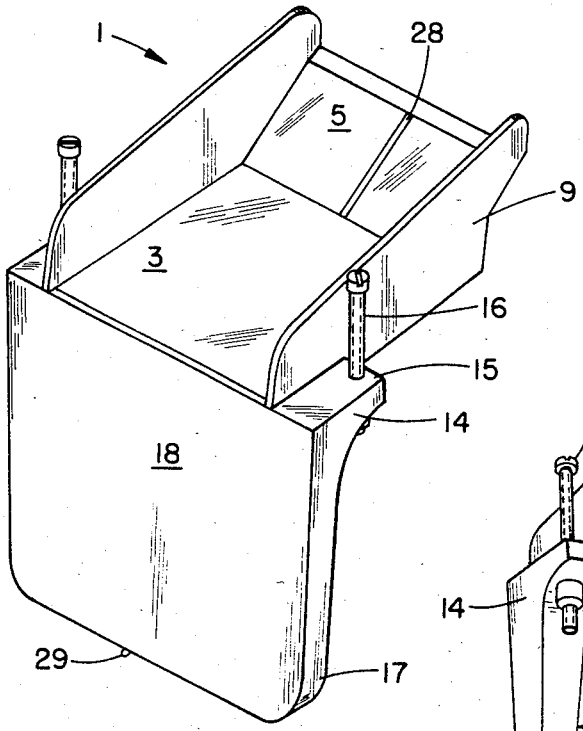
FIG. 1 is a perspective view, from the front of a sighting device according to the invention.
Figure 2:
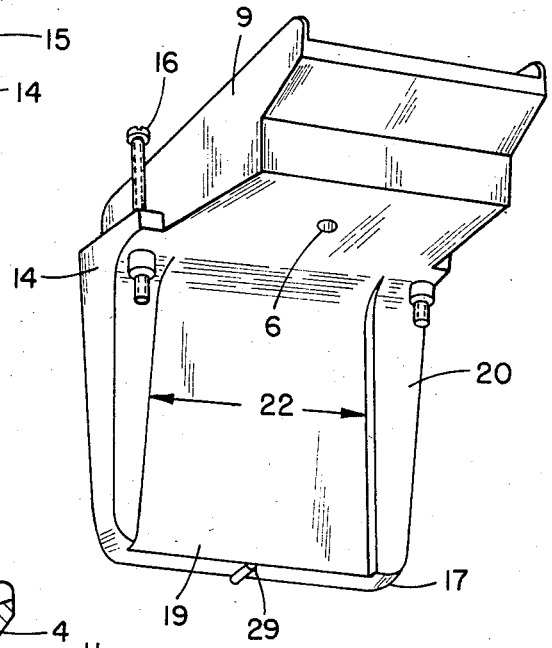
FIG. 2 is a perspective view of the device, from the rear.
Figure 3:
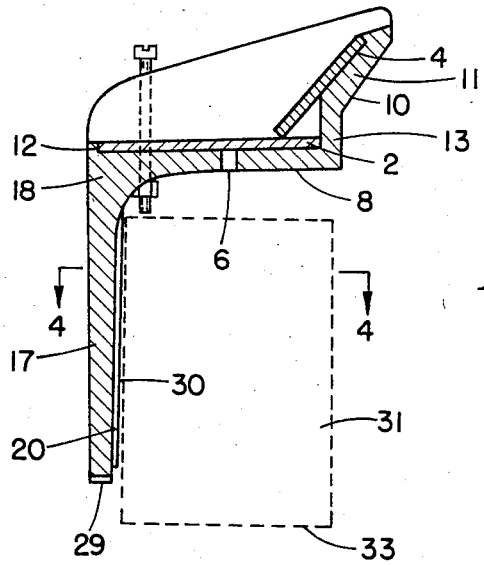
FIG. 3 is a sectional view of the device of FIG. 1.
Figure 4:
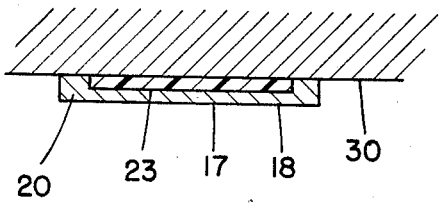
FIG. 4 is a sectional view in the direction of the arrows IV—IV in FIG. 3.

Referring to the drawings and initially to FIGS. 1 to 4 thereof there is illustrated a sighting device according to the invention indicated generally by the reference numeral 1. The device 1 comprises an eye aligning mirror 2 having a reflective surface 3 which, as will be described in more detail below in use is arranged to lie substantially in a horizontal plane. The device 1 also comprises a ball and target aligning mirror 4 having a reflective surface 5 which is inclined rearwardly upwardly in this case at a fixed dihedral angle of 135° to the reflective surface 3 of the eye aligning mirror 2. In this case the reflective surface 3 of the eye aligning mirror 2 extends below and forwardly of the reflective surface 5 of the ball and target aligning mirror so that the reflective surfaces form a substantially continuous reflective surface in which a target path between a ball and target may be viewed.

The mirrors 2, 4 are housed in a mounting frame comprising a base 8, upstanding side walls 9 and a cranked rear wall 10 interconnecting the side walls 9. Portion 11 of the rear wall 10 is inclined at an angle of 45° to the vertical to provide a bed in which the ball and target aligning mirror 4 is mounted and retained in position with a suitable adhesive material. The base 8 of the frame together with an upstanding front lip 12 and a lower portion 13 of the rear wall 10 provide a bed in which the horizontally disposed eye aligning mirror 4 is mounted using any suitable adhesive. A ventilation hole 6 is provided in the base 8 to facilitate the expulsion of any air which may be trapped between the mirror 4 and the base 8 as the mirror is being mounted into position. In addition to protecting the mirrors from damage the side walls 9 of the frame also act somewhat in the manner of blinkers for concentrating the eye of the player on the mirrors and excluding extraneous images.

A lug 14 projects from each side of the base 8 of the mounting frame at the front thereof and each lug 14 includes a through hole 15 in which an adjusting and locating screw 16 is threadingly engaged. As will be described in more detail below the screws 16 are utilized in aligning the frame and hence the mirrors into the correct orientation. The screws 16 are a relatively tight fit in the holes 15 so that once set up they cannot easily be moved.

A front flange 17 extends downwardly at an angle of 90° to the flat base 8 of the frame. The front face 18 of the flange 17 is flat to provide, in use, a striking surface for a ball. The rear face 19 of the flange 17 has projections extending therefrom, in this case a pair of rearwardly projecting ribs 20 extending vertically substantially the length of the flange 17. The ribs 20 are spaced-apart to define a channel 22 for reception of a mounting means which in this case is formed from a fixing compound particularly a deformable bonding agent 23. Ideally the bonding agent used is that sold under the trade name "BLUE TAC".

Figure 5:
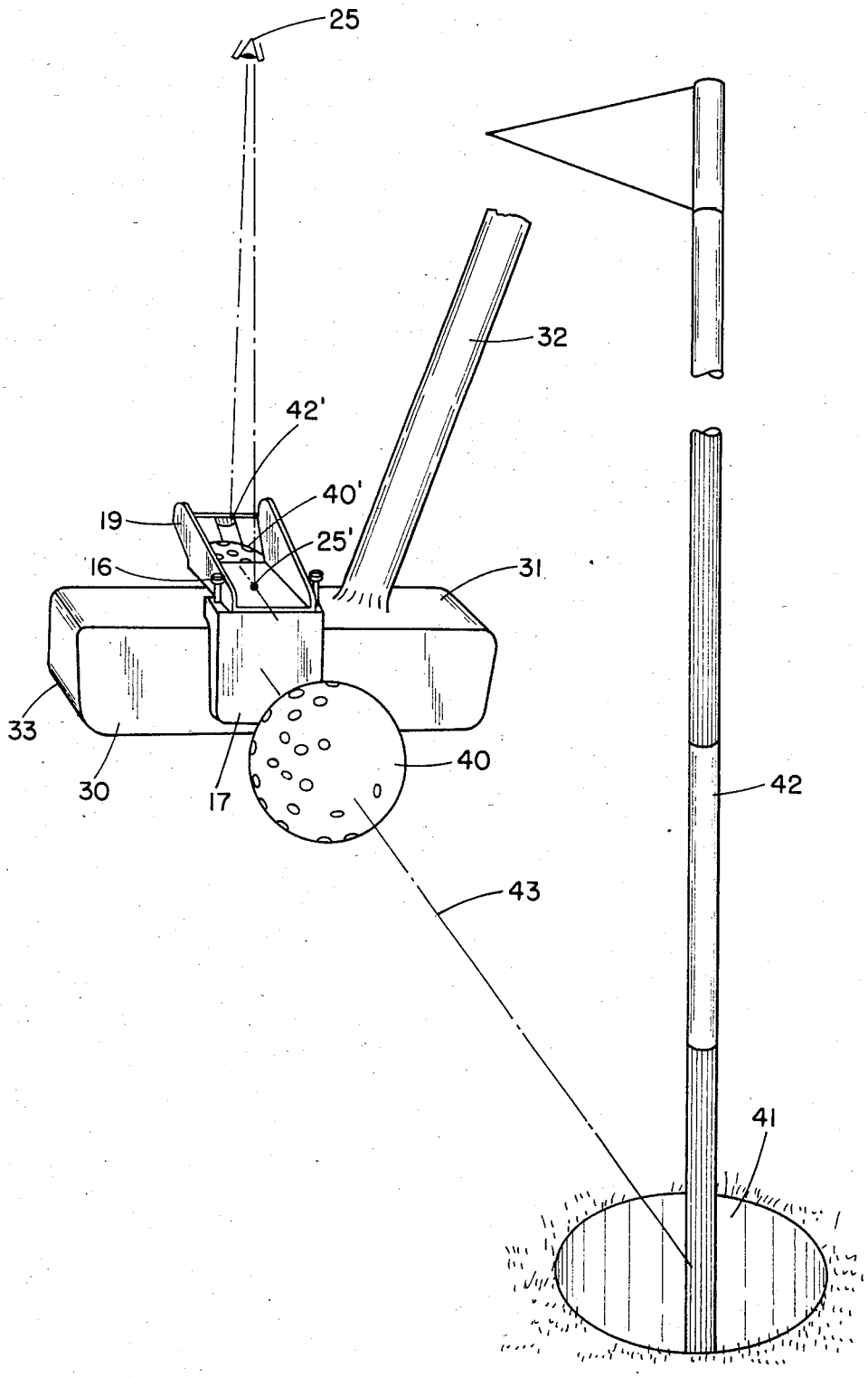
FIG. 5 is a perspective view of the sighting device of FIGS. 1 to 3 in use, mounted on the blade of a golf putter.
Figure 6:
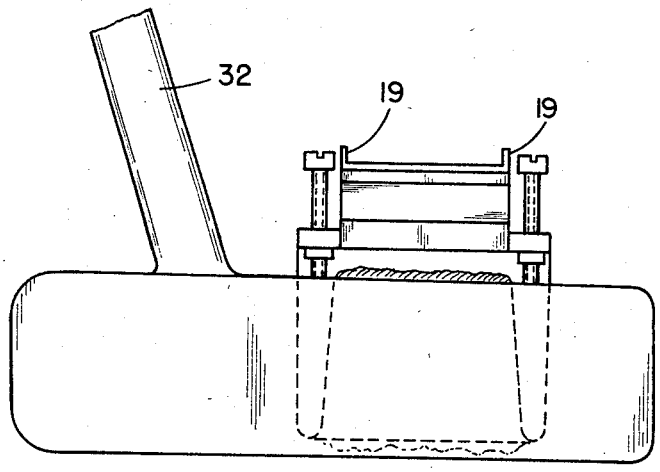
FIG. 6 is a rear view of the device mounted on a putter blade.

In use and referring particularly to FIGS. 5 and 6 a small, pea-sized quantity of the deformable bonding agent 23 is first kneaded and then placed in the channel 22 between the ribs 20. The device 1 is attached to the front striking or putting face 30 of a blade 31 of a putter 32 by pressing the flange 18 against the face 30 to spread the bonding agent in the chamber defined by the rear face 19 and ribs 20 of the flange 18 and the front face 30 of the blade 31, until the ribs 20 bear against the putting face 30. In this way the device is arranged so that the front face 18 of the flange 17 is parallel with the striking face 30 of the putter blade 31. Surplus bonding agent 23 is squeezed out of the chamber at the lower end of the flange 17.

The particular bonding agent used provides sufficient adhesion between the blade 31 and the flange 17 while allowing ease of attachment and removal of the device. In addition to providing a simple and effective means of releasably attaching the mounting frame to the blade 31 of the putter 32 the bonding agent also provides a resilience behind the striking flange 17 which neutralises the increase in weight of the putter head due to the attachment of the device. This is of considerable importance since it means that the putter blade will perform in precisely the same manner whether the sighting device is attached or not. Thus, a golfer may use the device in conjunction with his favourite putting club in practice and will still be able to use the same putter in competition play under the rules of golf. Under the rules of golf it is not permissible to modify the putter blade in any way to make it suitable to accept a sighting device even if such a sighting device is not used in actual play. Thus, with a sighting device in accordance with the invention there is no requirement for the player to re-adjust from a practice putter to a putter which may be used in competitive play.

A further advantage is that the sighting device is easily carried in a trouser or jacket pocket as it is relatively small and light.

One important advantage of the front flange 17 is that it assists a player in practising striking the ball off the so-called sweet-spot of the putting face 30 of the blade 31. The sweet-spot is defined as that point on the blade which will propel the ball in a straight line provided the putter is swung correctly. It generally lies approximately mid-way along the putting face of the blade 31. Some putters have a small mark on the top face of the blade 31 indicating the location of the sweet-spot.

Another important advantage of the front flange is that it facilitates the mounting of the device on the front putting face of the blade of any putter. The putter may be of the type in which the shaft extends from the blade from a position adjacent one end or from any position on the blade, including a centre shafted putter. The putter may be of any cross-section and may, for example, have a curved back face such as putters presently sold under the Mark "PING".

Thus, the device may be used with any known putter without having to permanently modify the putter.

In use, the device is mounted on the putter blade 31 so that the sweet-spot lies at the centre of the front flange 17 of the mounting frame. This not only ensures that the putter blade remains correctly balanced but also assists the player in striking the ball correctly off the sweet-spot. The sweet-spot of the blade coincides with the center line of the front flange 17 which includes a downwardly projecting pip 29 for assisting the player in lining up the centre of the flange with the centre of the ball.

To illustrate that the sighting device when correctly mounted on a putter blade does not in any way alter the balance of putter we have conducted an experiment in which a conventional putter was pendulously mounted and lined up to strike a ball with the sweet-spot of the blade. The putter was then drawn back a predetermined distance and released. When struck by the blade the ball travelled a measured distance along a predetermined path. The same experiment was repeated using the same ball and the same putter but this time with a sighting device as described above with reference to FIGS. 1 to 6 mounted on the blade of the putter so that the centre line of the front flange co-incided with the sweet-spot of the blade. Again, the putter was drawn back for the same predetermined distance and it was found that the ball travelled almost exactly the same distance along the same predetermined path. This experiment illustrates that the sighting device may be used on a player's favourite putter during practice while still allowing the putter to be used in play under the rules of golf without the player having to make any adjustments to compensate for difference in balance or weight of the putter.

To adapt the sighting device 1 to a putter blade 31 the player places the bottom face or sole 33 of the blade 31 flat on a hard horizontal surface. Since putter blades vary considerably in shape, a means of levelling the sighting device with respect to the generally horizontal sole 33 of the putter blade is usually required. The ball and pin aligning mirror 4 is first sighted on a vertical object such as the edge of a door, or a plumb line. The device is then moved relative to the putter blade 31 by adjusting the screws 16 until the image of the vertical object is vertical in the ball and target aligning mirror 4 and the image of his eye 25 as appears on the horizontal mirror 2 is in line with or coincides with the image of the vertical object. Once the adjusting screws have been set up in this manner provided the golfer continues to use the same putter, it is only necessary to line the device up so that the tip of each screw 16 bears against the upper face of the putter blade 31 for re-attachment. To facilitate this, the adjusting screws 16 may be fixed in position for example by a lock nut once they have been initially set up.

In practice, the blade 31 with the device 1 mounted thereon is offered up to a ball 40 to be propelled into a target hole 41 having a vertically upstanding target pin 42. A target line indicated by the reference numeral 43 may be drawn between the center of the ball 40 and the central axis of the hole 41 and in order for the ball 40 to be propelled into the hole 41 it should travel along this path 43. The ball 40 and pin 42 are first lined up using the inclined mirror 4. The position of the putter blade 31 is adjusted until the image 42′ of the pin extends perpendicularly through the reflective surface 5 of the inclined mirror 4 along a central marking line 28 and bisects the image 40′ of the portion of the ball visible in the mirror. The player then lines up the image 25′ of his own eye 25 which appears in the reflective surface 3 of the horizontal mirror 2 until the image 25′ is along the target line extending between the images 40′, 42′ of the ball and pin. Once the putter has been set up in this way, the players eye will then be over the target line, and the putter will be aligned with its sole 33 horizontal and the striking or front face 30 of the putter blade 31 will be in a plane substantially at right angles to the target line 43. The blade 31 is then drawn back slightly several times from the ball by the player in his usual putting swing, to ensure that his swing will be along the target line and that his eye will continue to be over this target line. Provided the image of the pin can be seen in the inclined mirror throughout the swing the blade is moving along the correct path.

The function of the eye aligning mirror with the reflective surface which is substantially horizontal in use, is to allow the player's eye to lie over the ball, in which position the player is best able to judge the correct target line to the pin. The target line to the pin varies as the position of the eye changes and this line is most likely to be correct when the eye is vertically over the ball. A secondary function of this mirror is to enable the putter blade to be arranged with its sole or bottom face lying in a horizontal plane.

In the case where the golfer wishes to direct the ball either to the right or left of the pin to allow for sloping of the putting surface the blade may be adjusted so that the image of the player's eye is slightly to the left or to the right of the image of the target. In effecting this adjustment he is automatically changing the direction in which the putter will propel the ball.

Figure 7:
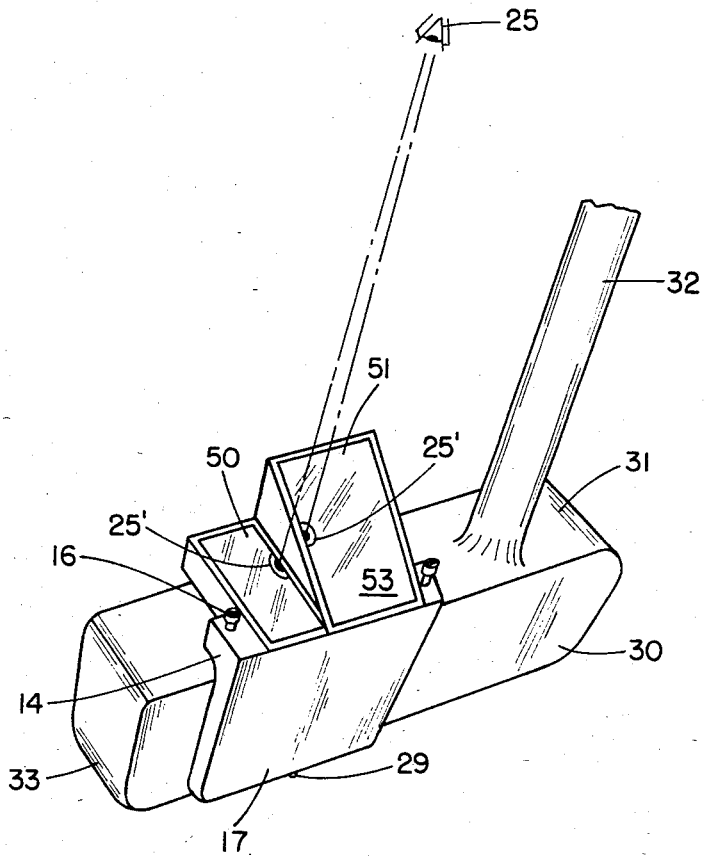
FIG. 7 is a perspective view from the front of another sighting device according to the invention, mounted on a golf putter blade.

Referring to FIG. 7 an alternative construction of sighting device according to the invention as shown attached to a putter blade 30. For convenience, parts similar to those described above with reference to the device of FIGS. 1 to 6 are assigned the same reference numerals. In this case the eye aligning mirror 50 extends below and sidewardly of the ball and pin aligning mirror 51. In use, the putter will be aligned in the correct position when the image 42'of the pin of 42 in the mirror 51 and the image 25' of the golfer's eye 25 are in the half-overlap position, half the image lying on the reflective surface 52 of the eye aligning mirror 50 and half on the reflective surface 53 of the inclined ball and pin aligning mirror 51.

Optically the device illustrated in FIG. 7 will operate in a similar manner to the device illustrated in FIGS. 1 to 6 however it is slightly more difficult to operate, it is more difficult to balance correctly and the mirrors are not as well protected as with the device illustrated in FIGS. 1 to 4. Other similar optical arrangements include an arrangement in which the eye aligning mirror is behind the inclined ball and target aligning mirror. The mirrors may also be off-set.

Either or both of the mirrors may be formed from two mirrors which abut along a central abutting line. For example the ball and target aligning mirror may be formed from two mirrors having reflective surfaces which were inclined inwardly so that the angle between the reflective surfaces is slightly less than 180°. When the images of the pin in both mirrors are symmetrical in relation to the central abutting line between the mirrors the striking face of the putter blade will be perpendicular to the target line.

A golfer practising with a device according to the invention will improve his own natural set-up on putts in competition. Repitition of the procedure required when a sighting device according to the invention is used in practice will allow the golfer to see and quantify the errors he is making. By using the device regularly in time the golfer can discover his tendency towards error and correct it as his eye becomes accustomed to the correct geometrical orientation of eye, putter blade, ball and pin to the feel of a correctly executed putting stroke. The device has the added advantage of improving the physiological attitude of the player as continued success with the device convinces him that he can sink every putt. To maintain the correct physiological as well as physical attitude it is of course essential that the player does not have to adjust from using a different club in practice to that used in play under the rules for golf.

In all cases it will be appreciated that the inclined mirror may be provided with a plurality of spaced-apart parallel calibration lines for indicating the relative or absolute distance the ball is from the target which may be used for converting into an indication to the player as to the desirable amplitude of the putt or swing to propel the ball the required distance.

While in the specific embodiments of the invention which have been described the means for mounting the device onto putter blade comprises a deformable bonding agent it will be appreciated that it may be possible to use any other suitable mounting means. For example, an adhesive which may be removed with or without the aid of a solvent could be used. In addition, a strip of VELCRO or similar material on the blade and a complementary strip of VELCRO on any suitable location on the mounting frame may be used.

It will also be appreciated that while the use of the downwardly extending flange over the putting face of the blade gives considerable advantages it may not be an essential feature. For example, instead of having the flange extending over the putting face of the blade the flange may extend from a suitable location on the frame downwardly over the back face of some putters. Additionally, or alternatively for some putters two relatively narrow strip flanges extending partially over the front face or indeed the rear face of the blade may be used. In the case where two flanges extend partially over the putting face the area of the putting face around the sweet-spot may be left exposed. Indeed in some cases it is envisaged that a downwardly extending flange may not be required. For example, it may be possible to releasably mount the sighting device on the top face of at least some putter blades.

It will be further appreciated that in the case where a downwardly projecting flange is utilised any suitable projections may be employed. In the case where the projections are ribs they may extend vertically downwardly as described or may extend horizontally or at any suitable angle and any number may be employed.

It will also be appreciated that while the side walls of the mounting frame give the particular advantages of protecting the mirrors against damage and cutting down on extraneous images they may be omitted from the mounting frame without departing from the scope of the invention.

I claim:

1. A sighting device for releasably mounting on the blade of a golf putter having a substantially planar front putting face with a substantially centrally disposed sweet spot, the sighting device comprising:

a. a putter blade mounting frame, including means for fixedly but releasably mounting the sighting device on a putter blade without alteration of the putter blade, such that the putter can be restored to its original condition after the sighting device is removed, said means for releasably mounting the sighting device on a putter blade comprising a front flange adapted to extend downwardly over the sweet spot of the putting face of a putter blade, and the front flange comprising a substantially vertically disposed planar front face for striking a ball, and the front flange having a rear face for interengagement with a fixing means for releasably mounting the frame on the putting face of a putter blade;

b. a mirror mounting frame fixedly mounted to said putter blade mounting frame, such that the mirror mounting frame is fixedly mounted thereby relative to the putter blade;

c. an eye aligning mirror fixedly housed in the mirror mounting frame, with the putter blade mounting frame and mirror mounting frame positioning a reflective surface of the eye aligning mirror to be behind the front flange and at right angles to the putting face of the blade in a substantially horizontal position when the putter is placed in position behind a ball prior to a putting stroke with the putter, such that an eye of the user can be sighted and aligned above the eye aligning mirror with an image of the eye therein; and d. a ball and target aligning mirror fixely housed in the mirror mounting frame behind the front flange and adjaent the eye aligning mirror, with the putter blade mounting frame and mirror mounting frame positioning a reflective surface of the ball and target aligning mirror to be inclined rearwardly and upwardly at an angle of approximately 135° with respect to the putting face, whereby the ball and target aligning mirror in use assists in aligning the putting face of the blade and said front flange square to a target path sight line between a ball and a target with the putter sweet spot being on the target path sight line, while the eye aligning mirror in use assists in aligning the eye of the user over the target path.

2. A sighting device as recited in claim 1, in which said fixing means comprises a fixing compound for releasably mounting the putter blade mounting frame on the putting face of a putter blade.

3. A sighting device as recited in claim 2, in which the fixing compound comprises a deformable bonding agent.

4. A sighting device as recited in claim 1 in which the flange includes formations projecting from the rear face of the flange to define, in use, together with the putting face of a putter blade a chamber for accommodating a predetermined quantity of fixing compound so that a ball struck off the front face of the flange will travel in substantially the same direction and substantially the same distance as when struck with the same blow off the sweet spot of the same putter blade without the sighting device attached.

5. A sighting device as recited in claim 4 in which the formations comprise a pair of spaced-apart downwardly extending ribs.

6. A sighting device as recited in claim 1 in which the device includes an adjusting means for aligning the mirrors relative to a putter blade.

7. A sighting device as recited in claim 6 in which the adjusting means comprises a pair of spaced-apart adjusting screws, a pair of sideward extension lugs on the mounting frame, and means for threadedly engaging the screws and the lugs, the shank of each screw extending through the corresponding lug to engage against the top face of the putter blade for adjustment of the mirrors relative the blade in a substantially vertical plane.

8. A sighting device as recited in claim 1 in which the reflective surface of the eye aligning mirror extends below and forwardly of the reflective surface of the ball and target aligning mirror, the reflective surfaces forming a substantially continuous reflective surface in which the target path is viewed.

9. A sighting device as recited in claim 1, in which the eye aligning mirror extends below and sidewardly of the ball and target aligning mirror.

10. A sighting device as recited in claim 1 in which the mounting frame includes a pair of side flanges extending upwardly from the side marginal edges of the reflective surfaces of the mirrors.

11. A sighting device as claimed in claim 1, in combination with a golf putter on which the sighting device is mounted by said putter blade mounting frame.

* * * * *